US009011981B2

(12) United States Patent
Bonin et al.

(10) Patent No.: US 9,011,981 B2
(45) Date of Patent: Apr. 21, 2015

(54) METHOD FOR MAKING A TEXTILE COVERING AND TEXTILE COVERING

(75) Inventors: Vincent Bonin, Saint Germain au Mont d'or (FR); Jerome Ville, Pommiers (FR)

(73) Assignee: Fibroline France, Ecully (FR)

( * ) Notice: Subject to any disclaimer, the term of this patent is extended or adjusted under 35 U.S.C. 154(b) by 1148 days.

(21) Appl. No.: 12/602,890

(22) PCT Filed: May 30, 2008

(86) PCT No.: PCT/FR2008/050963

§ 371 (c)(1), (2), (4) Date: Dec. 3, 2009

(87) PCT Pub. No.: WO2009/004202

PCT Pub. Date: Jan. 8, 2009

(65) Prior Publication Data

US 2010/0173549 A1 Jul. 8, 2010

(30) Foreign Application Priority Data

Jun. 12, 2007 (FR) ..... 07 55713

(51) Int. Cl.
*B05D 1/00* (2006.01)
*B05D 3/02* (2006.01)
(Continued)

(52) U.S. Cl.
CPC ..... *D06N 7/006* (2013.01); *B05D 1/007* (2013.01); *D06N 7/0084* (2013.01);
(Continued)

(58) Field of Classification Search
CPC ..... B05D 1/007; B05D 3/0254–3/029; B05D 3/14; D06N 7/0052; D06N 7/006; D06N 7/0063; D06N 7/0068; D06N 7/0076; D06N 7/0084; D06N 3/0011; D06N 3/004; D06N 3/0084; D06N 3/0093; D04H 11/08; D04H 1/60; D04H 1/62; D04H 1/736; D04H 3/03; D04H 3/102; D04H 3/12; D04H 3/163
USPC ..... 427/462–465, 472, 475, 474, 484, 485, 427/532
See application file for complete search history.

(56) References Cited

U.S. PATENT DOCUMENTS 2,820,716 A * 1/1958 Plummer et al. ..... 427/474
3,150,023 A 9/1964 Penman
(Continued)

FOREIGN PATENT DOCUMENTS

DE 19737864 A1 3/1999
EP 1526214 A 4/2005
(Continued)

OTHER PUBLICATIONS

Webster's Ninth New Collegiate Dictionary; Merriam-Webster incorporated, publishers Springfield, Massachusetts, USA; 1990 (no month); excerpt p. 1307.*
(Continued)

*Primary Examiner* — Marianne L Padgett
(74) *Attorney, Agent, or Firm* — Heslin Rothenberg Farley & Mesiti P.C.

(57) ABSTRACT

A textile coating is made from a web of fibers including a first area and a second area. The first area is a cohesion area where the fibers of the web are integrated into a tight entanglement holding the fibers and located on only a portion of the thickness of the web. A method for making the textile coating includes: applying an alternating electric field to the web having at least one face bearing a heat-meltable powdery binder, thereby introducing said powdery binder into the web, so as to concentrate the binder at the first area, then melting the binder by supplying heat, and leaving the binder to cure or causing it to cure.

7 Claims, 2 Drawing Sheets

(51) Int. Cl.

| | |
|---|---|
| ***D06N 7/00*** | (2006.01) |
| ***D04H 1/60*** | (2006.01) |
| ***D04H 3/12*** | (2006.01) |
| ***D04H 11/08*** | (2006.01) |
| ***D06N 3/00*** | (2006.01) |

(52) U.S. Cl.

CPC ..... *B05D 3/0272* (2013.01); *D06N 7/0076* (2013.01); *D04H 1/60* (2013.01); *D04H 3/12* (2013.01); *D04H 11/08* (2013.01); *D06N 3/0084* (2013.01); *D06N 3/0093* (2013.01)

(56) References Cited

U.S. PATENT DOCUMENTS

| | | | | | |
|---|---|---|---|---|---|
| 3,150,024 | A | * | 9/1964 | Penman | 156/229 |
| 3,286,007 | A | * | 11/1966 | Wilkie et al. | 264/119 |
| 3,506,530 | A | * | 4/1970 | Crosby | 428/92 |
| 3,936,558 | A | * | 2/1976 | Bolen et al. | 428/212 |
| 3,978,257 | A | * | 8/1976 | Ring | 428/137 |
| 4,702,940 | A | * | 10/1987 | Nakayama et al. | 427/244 |
| 4,731,135 | A | * | 3/1988 | Tani et al. | 156/62.6 |
| 4,731,274 | A | * | 3/1988 | Ishida et al. | 428/87 |
| 5,419,953 | A | * | 5/1995 | Chapman | 442/35 |
| 5,538,776 | A | * | 7/1996 | Corbin et al. | 428/95 |
| 5,736,473 | A | * | 4/1998 | Cohen et al. | 442/239 |
| 6,589,606 | B2 | * | 7/2003 | Waterkamp et al. | 427/458 |
| 6,733,845 | B1 | * | 5/2004 | Caramaro et al. | 427/477 |
| 2004/0171763 | A1 | * | 9/2004 | Van Geenen et al. | 525/423 |
| 2006/0233966 | A1 | * | 10/2006 | Marduel | 427/475 |
| 2007/0270064 | A1 | * | 11/2007 | Aseere | 442/150 |

FOREIGN PATENT DOCUMENTS

| | | | | |
|---|---|---|---|---|
| GB | 769760 | | * | 3/1957 |
| GB | 2118484 | A | | 11/1983 |
| GB | 2151545 | A | * | 7/1985 |
| WO | WO 2005/038123 | A | | 4/2005 |

OTHER PUBLICATIONS

International Search Report for PCT/FR2008/050963 dated Nov. 28, 2008.

* cited by examiner

METHOD FOR MAKING A TEXTILE COVERING AND TEXTILE COVERING

CROSS REFERENCE TO RELATED APPLICATIONS

This application is a national stage filing under section 371 of International Application No. PCT/FR2008/050963 filed on May 30, 2008, and published in French on Jan. 8, 2009 as WO 2009/004202 A1 and claims priority of French application No. 0755713 filed on Jun. 12, 2007, the entire disclosure of these applications being hereby incorporated herein by reference.

TECHNICAL FIELD

The present invention concerns a method for making a textile covering, and such a textile covering, which may in particular be a floor covering, a wall covering or a trim carpet for the passenger compartment of a vehicle.

PRIOR ART

It is known to make textile coverings from a needle punched fibrous web and in particular from a velour fibrous web, which is a web that has been needle punched in such a manner that a part of its thickness is formed essentially of joined loops. The fibers of such a loop originate in an area located beneath the loops and in which the fibers are intertwined and thus partially interlinked.

When manufacturing the covering, the back of the velour web is impregnated with an aqueous solution of latex. Then the whole is subjected to drying, the function of which is to remove the water from this solution until the latex crosslinks, but which involves the drawbacks of requiring sizeable equipment and of being costly.

Once drying has been carried out, the latex forms bridges which link the fibres of the web with one another, in the area located beneath the loops.

Latex is non-thermoplastic and its presence in the textile covering is detrimental to recycling of the latter.

Using a latex solution involves other drawbacks than that of requiring a drying phase. In particular, it entails the pollution of considerable quantities of water the decontamination of which requires a dedicated purification installation, which entails substantial investments and maintenance costs.

For example, it is also known from document DE 197 37 864 to make a textile coating by coating the underside of a web of fibres with a coating which can be deposited in molten form before subsequently solidifying by cooling. This coating may also come from a powder or a heat-meltable film which is not caused to melt until it has been deposited on the underside of the web. In both cases, coating on the underside of the web does not allow satisfactory mechanical properties to be obtained, in particular in terms of dimensional stability and abrasion resistance of the textile coating.

DESCRIPTION OF THE INVENTION

At least one aspect of the invention is to simplify the manufacture of a textile covering, without it entailing a deterioration of certain mechanical properties of said textile covering.

According to the invention, this aspect is achieved by a method for making a textile covering from a web of fibers comprising a rear face, a first area, a second area and a front face, the first area being a cohesion area in which the fibers of the web are integrated into a tight entanglement holding these fibers and which is located on only a portion of the thickness of the web, the second area extending over another portion of the thickness of the web until said front face. This method comprises stages in which:

a) by applying an alternating electric field to the web of which at least one of the front and rear faces bears a heat-meltable powdery binder, this powdery binder is introduced into the web of fibers, in such a manner as to concentrate said binder at the first area, then c) the binder is caused to melt by supplying heat, then d) the binder is left to cure or caused to cure.

It was found, surprisingly, that the alternating electric field concentrates the powdery binder in the cohesion area. Rather it would have been expected that the alternating electric field would disperse the powdery binder over the entire thickness of the textile covering, to the extent that it is known, for example, from document WO 99/22920, that a similar alternating electric field could be utilized effectively to perform homogeneous impregnation of a fibrous layer with powder.

Now it is a desideratum that the upper portion of the covering, that is, the second area, should contain as little binder as possible.

The method described above does not employ the formation of any solution and no drying is required. It may be implemented by means of a significantly smaller-sized and less costly installation than an installation handling a latex solution.

In addition, the above-defined method has the advantage of offering flexibility with respect to the quantity of binder in the textile covering and the location of this binder. This location may be altered by changing the face on which the powdery binder is deposited and/or by adjusting the proportion of this powdery binder deposited on one face of the web, compared with the quantity of powdery binder deposited on the other face of the web. The location of the binder within the web also depends on the residence time of the web between the electrodes, the setting parameters of the field produced by these electrodes, the specific characteristics of the powder and in particular on its granulometry, and on the denier of the web fibers and the density of said web.

Advantageously, the heat-meltable binder is more specifically a thermoplastic binder. It may also be of a different nature. For example, the heat-meltable binder may be a binder that is meltable at a first temperature and thermosettable at a second temperature higher than this first temperature. For example, the heat-meltable binder can be a polyethylene, a polypropylene, a polyester, an epoxy resin or a mixture of said substances.

The fibers of the web are advantageously made of a polymer, such as a polypropylene, a polyester, a polyamide or a mixture of said substances. They may also be cellulose fibers. The web can also comprise different kinds of mixed fibers.

Advantageously, between the stages a) and c), the method comprises a stage in which:

b) at least a portion of the powdery binder that may be present in the second area of the web is removed by subjecting the front face of this web to a cleaning operation.

Advantageously, between the stages a) and c), the method comprises a stage in which:

b) a portion of the powdery binder is removed by subjecting the rear face of the web to a cleaning operation, such as cleaning by extraction or brushing.

Advantageously, the powdery binder is a mixture of powders of different chemical compositions.

Advantageously, the method comprises a stage in which the rear face is coated with a coating containing fillers.

A further aspect of the invention is a textile covering a comprising a web made of fibers and which comprises a rear face, a first area, a second area and a front face, the first area being a cohesion area in which the web fibers are integrated into a tight entanglement holding these fibers and which is located on only a portion of the thickness of the web, while the second area extends over another portion of the thickness of the web, above said first area, until said front face, a heat-meltable binder links fibers of the web with each other and is concentrated in the first area which comprises a core and a surface area linking said core to the rear face of the web, the proportion of heat-meltable binder in relation to the fibers being lower in the surface area than in the core.

It is thought that prior to the invention of the method defined above, it was not known how to obtain a lower proportion of heat-meltable binder in the surface area of the first area, in relation to the proportion of binder in the core of said first area or, at least, how to obtain it in a manner that is simple and economical enough not to be impractical.

Since the proportion of heat-meltable binder in relation to the fibers is lower in the surface area than in the core, a smaller quantity of binder can be employed without significantly reducing the robustness of the textile covering, which has the advantage of resulting in savings. In addition, a sub-layer such as a coating can cover the lower face of the web. It is easier to make it adhere to the rear face of the web if this rear face contains little binder. In the absence of a sub-layer, the rear face of the web also forms the rear face of the covering.

The heat-meltable binder is advantageous in that it can be melted again by means of further heating of the textile covering, after which this covering can be shaped by compression between two forming blocks.

Advantageously, the textile covering results from the implementation of a method as defined above.

SUMMARY DESCRIPTION OF THE FIGURES

The invention will be clearly understood by reading the description that follows, which is provided solely by way of example and with reference to the attached drawings, which include:

POSSIBLE EMBODIMENT OF THE INVENTION

Figure 1:
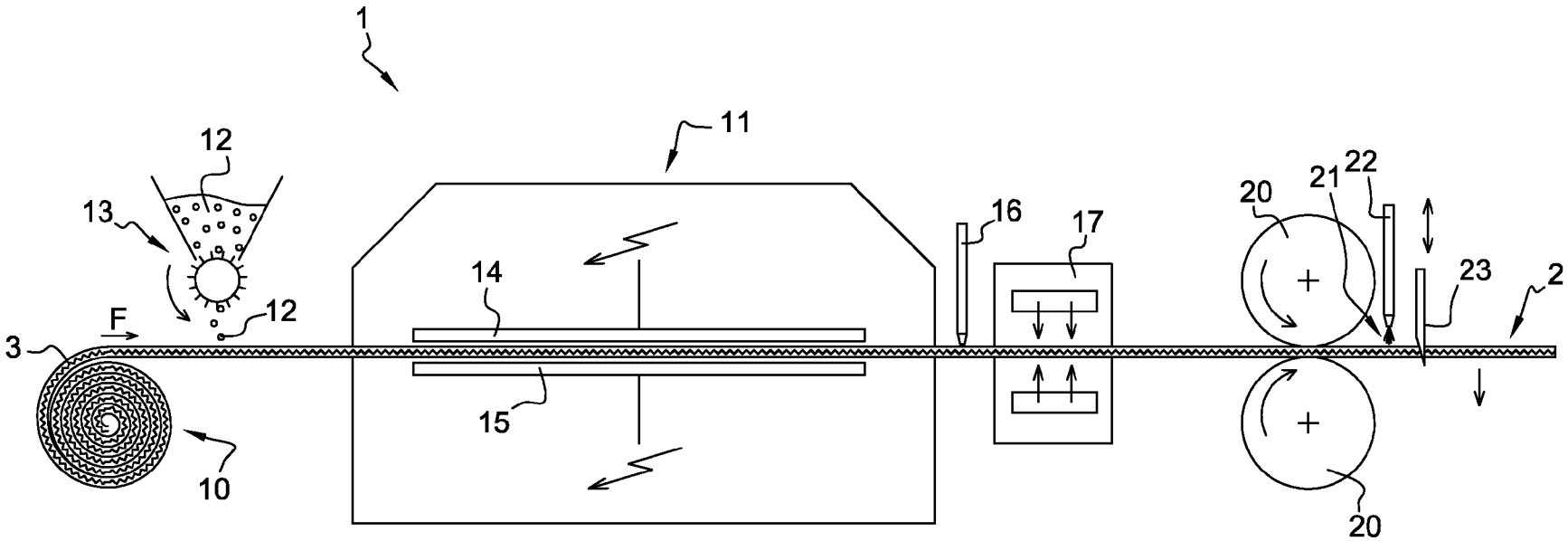
FIG. 1 is a schematic view of a carpet manufacturing installation in accordance with the invention, using a method also in accordance with the invention.

FIG. 1 shows an installation 1 for manufacturing textile coverings or carpets 2 from a velour needle punched web 3, using a method in accordance with the invention.

Figure 2:
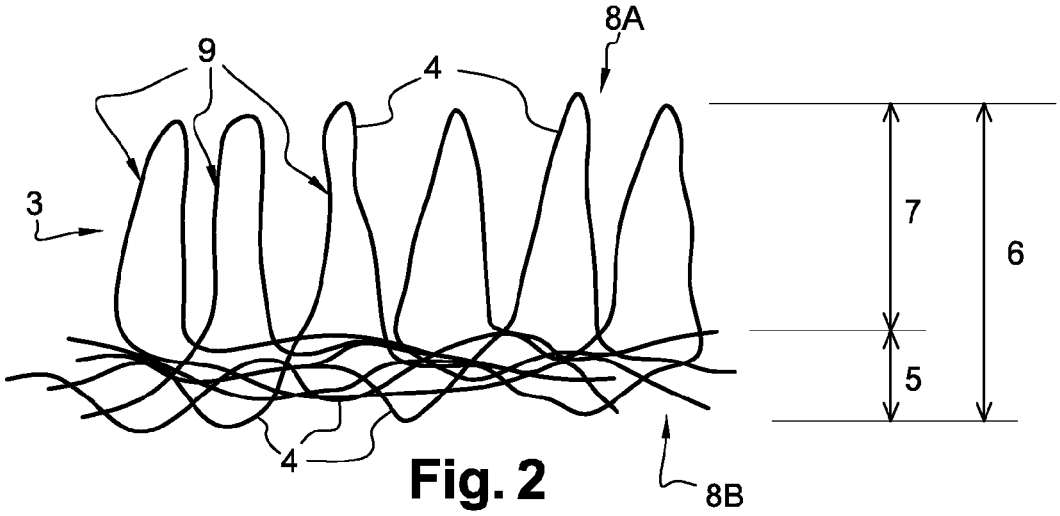
FIG. 2 is a schematic and partial view, in cross section, of a needled web from which the installation shown in FIG. 1 makes carpets.

As can be seen from FIG. 2, the web 3 is initially dry, that is, not impregnated. It is made up of polymer fibres 4 which are intertwined and thus form a tight entanglement 5 located on only a portion of the thickness 6 of the web 3. The entanglement 5 holds the fibres 4 and is located beneath another portion 7 of said thickness 6. The fibres 4 are generally independent of one another in said other portion 7, where they form loops 9 and which extends up to one of the two principal faces 8A and 8B of the web 3, that is, its face 8A which is intended to form the upper part or front face of the carpet 2, the face 8B being intended to form its lower part or rear face.

In the example shown, the web 3 comprises loops 9 on its face 8A, since it is a velour needled web. However, the web 3 may exhibit ordinary needling, that is, it may not be velour.

At the entry point to installation 1, a roller 10 of web 3 unreels towards an impregnation device 11, in the direction symbolized by the arrow F in FIG. 1. Upstream of this impregnation device 11, a substance, essentially consisting of a heat-meltable powdery binder 12 and which may also contain one or more additives, in particular fluidizing additives, is sprinkled onto one of the main faces 8A and 8B of the web 3. This binder 12 is made of a heat-meltable material whose melting temperature is lower than that of the fibres 4. Its flow rate is metered by a sprinkling device 13 synchronized with the feed speed of the web 3 in the F direction.

The impregnation device 11 comprises two opposite electrodes 14 and 15 which are generally plane and parallel to one another, between which passes the web 3 bearing the powdery binder 12. These electrodes 14 and 15 generate between them an alternating electric field which is applied to the web 3 and the powder of binder 12 at the same time. This field causes the powdery binder 12 to penetrate into the thickness of the web 3, including into its entanglement 5. It was also found, surprisingly, that the alternating electric field produced between the electrodes 14 and 15 concentrates the powdery binder 12 at said entanglement 5 in such a manner that, at portion 7 of the web 3, the fibres 4 contain virtually no powdery binder 12, which is a desideratum.

Likewise preferably, the electrodes are plane and parallel to each other. However, in some cases, it may be advantageous to use electrodes having a different shape and/or which are not parallel to one another. These electrodes may in particular be like those described in the document WO 2005/038123.

Figure 3:
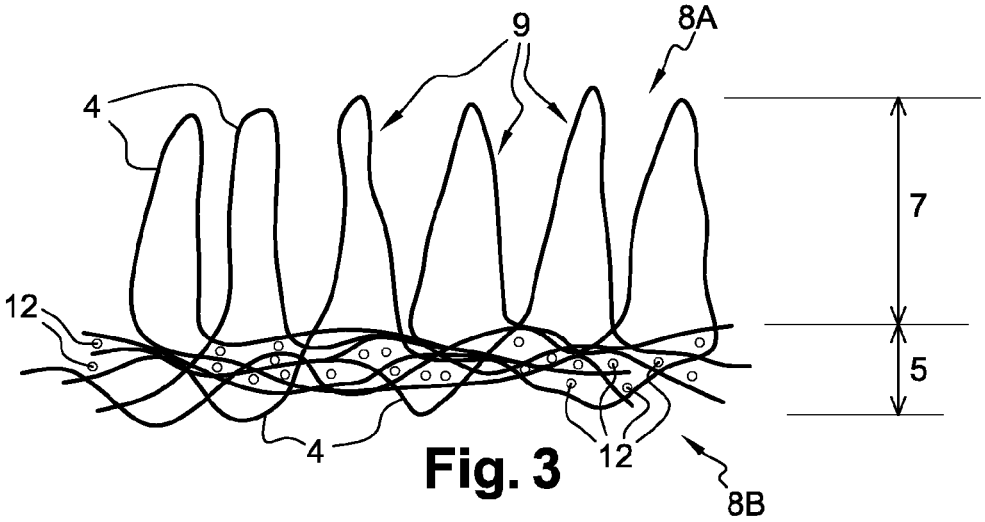
FIG. 3 is a view analogous to FIG. 2 and shows an intermediate stage in which the fibrous web of FIG. 2 is to be found during its transformation into the carpet in the installation of FIG. 1.

At the exit point of the impregnation device 11, an extractor 16 subjects the face 8A to extraction, that is, a cleaning operation intended to remove any grains of binder 12 located in portion 7 of the web 3. This aspiration may optionally be eliminated by being replaced by brushing. The structure of the web 3 immediately after the extractor 16 can be seen in FIG. 3, where it can be seen that the powdery binder 12 is concentrated mainly at the entanglement 5.

Downstream of the extractor 16 is located a hot-air oven 17, in which a supply of heat causes the binder 12 to melt. Thereupon the web 3 passes between two press rollers 20.

Once it has passed through the press rollers 20, the web 3 is subjected to a cooling air stream 21 expelled from one or a plurality of nozzles 22 and which causes solidification of the binder 12. The rollers 20 may also be cooled and contribute to solidification of the binder 12. They can even cause said solidification without the presence of the cooling air stream 21. It is also possible to allow cooling of the binder 12 to take place on its own.

After solidification of the binder 12, the web 3 forms a textile covering, which is cut into several carpets 2 by a knife 23 in the example shown.

Figure 4:
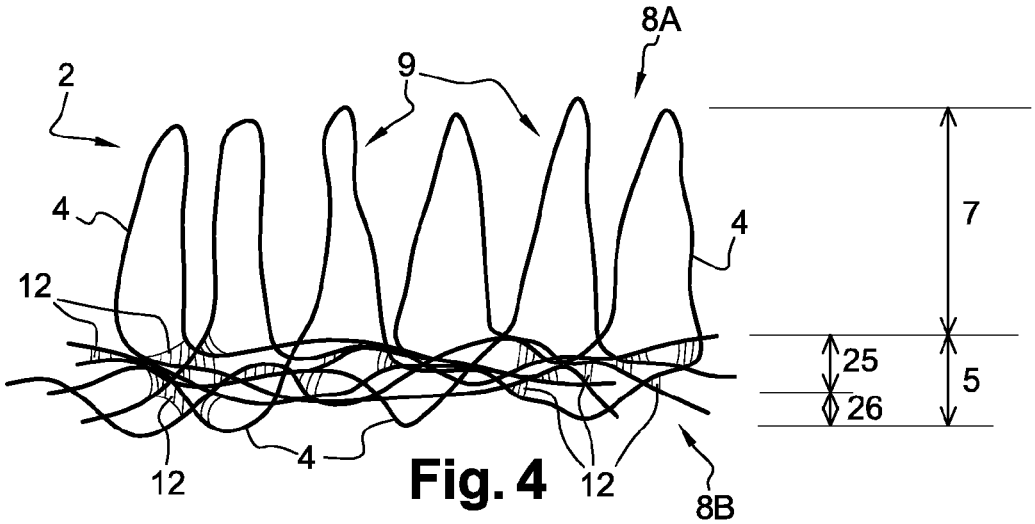
FIG. 4 is a view analogous to FIGS. 2 and 3, and shows the structure of a carpet in accordance with the invention and produced by the installation of FIG. 1 from the needled web of FIG. 2.

The structure of a carpet 2 can be seen in FIG. 4, where it can be seen that only very little or no binder 12 is located at the loops 9. Bridges of binder 12 link the fibers 4 with one another at the entanglement 5 and, in doing so, join the loops 9 to the remainder of the carpet 2. The proportion by weight of binder 12 in relation to the fibers 4 varies in the thickness direction, at the entanglement 5. More specifically, this proportion is greater at a core 25 of the entanglement 5 than at a surface area 26 which borders on said core 25 at the opposite end of the portion 7 and defines the lower face 8B of the carpet 2.

The low proportion of binder 12 in the surface area 26 can be ascertained visually on the lower face 8B. It can also be verified by measurements. These measurements can be based on a comparison by thermal analysis of the melt enthalpy of the fibres 4 alone and the melt enthalpy of the sample to be evaluated, for a melting of only the fibres 4 present in this sample, excluding its binder 12. From this comparison, the proportion by weight of fibres 4 in the sample is deduced and therefore that of binder 12. The sample is prepared by grinding carried out in such a manner as to leave only that which has to be measured and to remove the remainder. For example, the sample prepared to measure the quantity of binder 12 in the surface area 26 results from a removal by grinding of the portion 7 and the core 25.

A heat-meltable binder 12 can be chosen that is compatible with the fibres of the carpet so that the carpet 2 can be recycled.

Several examples of carpet 2 made by using the method described above are proposed in what follows.

EXAMPLE 1

In this example, the web 3 was a velour needle punched product weighing 600 g/m$^2$ and having a thickness of approximately 6 mm. It consisted of a mixture of fibers 4 of 6.5 dtex, 17 dtex and 150 dtex, made of polypropylene and initially containing no binder.

The binder 12 consisted of high-density polyethylene, which was sprinkled at the rate of 90 g/m$^2$ on the web 3. Before being incorporated in this web, it was present in the form of a powder having a granulometry of 0 μm to 80 μm and is commercialized by the company ABIFOR (Wutöschingen—GERMANY) under the reference 1300/20.

Impregnation of the web 3 by the powdery binder 12 was carried out in the device 11 fitted with flat electrodes 14 and 15. The alternating electric field produced between these electrodes 14 and 15 had a value of 2 kV/mm and a frequency of 50 Hz. The web 3 containing the powdery binder 12 had an alternating electric field applied to it for 20 sec. It was then placed for more than 2 min. in the oven 17 set at a temperature higher than the melting temperature of the binder and lower than the melting temperature of the fibers.

A carpet 2 obtained according to this example 1 was subjected to the Lisson test as defined by the EN 1963 standard from the year 1997. Following this test, a determination by visual evaluation of the level of defibration of carpet 2 was performed and gave a value of ⅗ in the machine direction, that is, in the direction of arrow F in FIG. 1, and a value of ⅗ in the transverse direction, that is, in the direction perpendicular to the machine direction.

Following the Lisson test, the weight loss of the carpet 2 was also determined and gave a value of 58.7 g/m$^2$ in the machine direction and a value of 60.1 g/m$^2$ in the transverse direction.

The carpet 2 had an average thickness of 6 mm. The proportion of binder 12 over its entire thickness was evaluated at 29.5% by weight by the above-mentioned method and by employing measurements of melt enthalpy. The proportion of binder 12 in the last millimeter before the face 8B, that is, on the back of carpet 2, generally at its surface area 26, was evaluated at 16.9% by weight by the same method. It could be deduced from this that the proportion of binder 12 in the surface area 26 was lower than that in the core 25. This should be compared with the same measurements made on a second carpet, manufactured from the same web but utilizing the prior art method, that is, by using a latex solution.

The proportion of latex in the entire thickness of this second carpet was evaluated at 26.7% by weight by the above-mentioned method and by employing measurements of melt enthalpy. The proportion of latex in the last millimeter of the second carpet before its lower face, that is, on the back of this second carpet, was evaluated at 35.0% by weight by the same method.

EXAMPLE 2

In this example the same web 3 and the same binder 12 were used as in example 1.

This binder 12 was sprinkled at the rate of 120 g/m$^2$ on the web 3.

Impregnation of the web 3 by the powdery binder 12 was carried out in the device 11 fitted with flat electrodes 14 and 15. The alternating electric field produced between these electrodes 14 and 15 had a value of 2 kV/mm and a frequency of 50 Hz. The web 3 containing the powdery binder 12 had an alternating electric field applied to it for 20 sec. It was then placed for more than 2 min. in the oven 17 set at a temperature higher than the melting temperature of the binder and lower than the melting temperature of the fibres.

A carpet 2 obtained according to this example 3 was subjected to the Lisson test as defined by the EN 1963 standard from the year 1997. Following this test, a determination by visual evaluation of the level of defibration of carpet 2 was performed and gave a value of ⅘ in the machine direction, and a value of ⅗ in the transverse direction.

Following the Lisson test, the weight loss of the carpet 2 was also determined and gave a value of 36.8 g/m$^2$ in the machine direction and a value of 54.3 g/m$^2$ in the transverse direction.

EXAMPLE 3

In this example, the web 3 was a velour needle punched non-woven, weighing 550 g/m$^2$. Its fibers 4, which initially did not contain any binder, were made of polyester and had a denier of 6.7 dtex.

The binder 12 was an epoxy resin, which was sprinkled at the rate of 150 g/m$^2$ on the web 3. Before being incorporated in this web 3, it was present in the form of a powder having a granulometry of 0 μm to 100 μm and is commercialized by the company BAKELITE (GERMANY) under the reference 6171TP.

Impregnation of the web 3 by the powdery binder 12 was carried out in the device 11 fitted with flat electrodes 14 and 15. The alternating electric field produced between these electrodes 14 and 15 had a value of 3 kV/mm and a frequency of 50 Hz. The web 3 containing the powdery binder 12 had an alternating electric field applied to it for 20 sec. It was then placed for more than 2 min. in the oven 17 set at a temperature higher than the melting temperature of the binder and lower than the melting temperature of the fibres.

A carpet 2 obtained according to this example 2 was subjected to the Taber test. After this test, a determination by visual evaluation of the abrasion resistance of the carpet 2 was performed and gave a value of ¾.

EXAMPLE 4

In this example the same web 3 was used as in example 3.

The binder 12 was sprinkled at the rate of 140 g/m$^2$ on the web 3. Before it was incorporated in this web 3, it was present in the form of a mixture containing 20% by weight of a powder commercialized by the company BAKELITE (GERMANY) under the reference 6171TP and 80% by weight of a polypropylene powder having a melt flow index (MFI) equal to 120 and a granulometry of 0 μm to 200 μm. The "6171TP" powder had a granulometry of 0 μm to 100 μm.

Impregnation of the web 3 by the powdery binder 12 was carried out in the device 11 fitted with flat electrodes 14 and 15. The alternating electric field produced between these electrodes 14 and 15 had a value of 3 kV/mm and a frequency of 50 Hz. The web 3 containing the powdery binder 12 had an alternating electric field applied to it for 20 sec. It was then placed for more than 2 min. in the oven 17 set at a temperature higher than the melting temperature of the binder and lower than the melting temperature of the fibres.

The invention claimed is:

1. A method for making a textile covering from a needle punched web of fibers consisting of, in sequence along a thickness direction of the needle punched web, a rear face, a first area, a second area and a front face, the first area being a cohesion area in which the fibers of the needle punched web are intertwined into a tight entanglement holding said fibers and the first area extending from the rear face covers only a portion of a thickness of the needle punched web, the second area comprising loops of the fibers of the needle punched web extending over another portion of the thickness of the needle punched web, above said first area, until said front face, density of the fibers in the first area being higher than in the second area, comprising stages in which:

a) by applying an alternating electric field to the needle punched web with at least one of the front face and the rear face of the web bearing a heat-meltable powdery binder, the powdery binder is introduced into the needle punched web of fibers, so as to concentrate said binder at the first area, and leave the second area containing virtually no powdery binder, then c) the binder is caused to melt by supplying heat, then d) the binder is left to cure or caused to cure.

2. Method according to claim 1, wherein the web is a velour needle punched web.

3. Method according to claim 1, further comprising, between the stages a) and c), a stage in which:

b) at least a portion of any powdery binder present in the second area of the web is removed by subjecting the front face of the web to a cleaning operation.

4. Method according to claim 1, further comprising, between the stages a) and c), a stage in which:

b) a portion of the powdery binder is removed by subjecting the rear face of the web to a cleaning operation.

5. Method according to claim 1, wherein the powdery binder is a mixture of powders of different chemical compositions.

6. Method according to claim 1, further comprising a stage in which the rear face is coated with a coating containing fillers.

7. Method according to claim 1, wherein, in stage a), the powdery binder is concentrated in the first area in such a manner that a proportion by weight of the binder in relation to the fibers is lower in a surface area of the rear face than in a core of the first area.

* * * * *